United States Patent [19]

Verdin

[11] Patent Number: 4,697,226

[45] Date of Patent: Sep. 29, 1987

[54] LIGHT MOUNTING FOR FIREARMS

[76] Inventor: Joe L. Verdin, 9203 Glen Shadow, Houston, Tex. 77088

[21] Appl. No.: 884,735

[22] Filed: Jul. 11, 1986

[51] Int. Cl.[4] ..... F41G 1/34

[52] U.S. Cl. ..... 362/110; 42/103

[58] Field of Search ..... 42/103; 362/109, 110, 362/113, 114

[56] References Cited

U.S. PATENT DOCUMENTS

| | | | |
|---|---|---|---|
| 2,447,892 | 8/1948 | Baliff | 362/110 X |
| 2,657,303 | 10/1953 | Dickens | 362/110 X |
| 3,222,511 | 12/1965 | Breeding | 42/103 X |
| 4,000,403 | 12/1976 | Rice | 362/110 X |
| 4,542,447 | 9/1985 | Quakenbush | 362/183 |

FOREIGN PATENT DOCUMENTS

| | | | |
|---|---|---|---|
| 892113 | 12/1981 | U.S.S.R. | 362/110 |

*Primary Examiner*—Samuel Scott
*Assistant Examiner*—Allen J. Flanigan
*Attorney, Agent, or Firm*—Ranseler O. Wyatt

[57] ABSTRACT

In a light mount for firearm, particularly a shot gun, to selectively place a beam of light at the approximate point of impact from said firearm, having the usual barrel and magazine in vertical alignment, a semi tubular housing having a gap through which a flashlight may be passed, and a spring housing adjacent said semi tubular housing, and a base member on which said spring housing is mounted, a support on said base member adapted to receive the barrel and magazine and a band, or strap, to pass through slots in the spring housing and vertically around the spring housing, flashlight housing and barrel, and secured to aid in maintaining the flashlight housing in position on said barrel.

4 Claims, 3 Drawing Figures

LIGHT MOUNTING FOR FIREARMS

BACKGROUND OF THE INVENTION

In police work, particularly SWAT teams, short barreled shot guns are employed and particularly at night, have proven to be a most effective weapon; however, the use of such weapons in the city, particularly where there may be people moving around the area, it is essential to the officer to be able to see the target. To mount a flashlight on a firearm, by itself, is not new, but to mount a light that will not be readily loosened or displaced by the discharge of the weapon has been a long sought after goal. It is an object of this invention to provide means for mounting a light on a firearm that will not be easily displaced and that may be effectively employed by police and the like for night shooting.

The closest reference known to this Applicant is Quackenbush, U.S. Pat. No. 4,542,447, issued Sep. 17, 1985, Class 362/183, however this reference discloses a flashlight secured underneath the firearm barrel, where the magazine and loading mechanism is located, which tends to dislodge the light and interferes with the handling of the gun.

SUMMARY OF THE INVENTION

A light holder mounted on the top surface of a shot gun barrel having a cylinder in which a flashlight may be inserted, and a locking means anchoring the flashlight in the desired position and having a strap around the flashlight and barrel to hold down the rear end of the flashlight upon discharge of the weapon, and having a touch switch connected to the light and selectively anchored adjacent the firing hand of the user for activating the light.

DESCRIPTION OF THE PREFERRED EMBODIMENT

Figure 1:
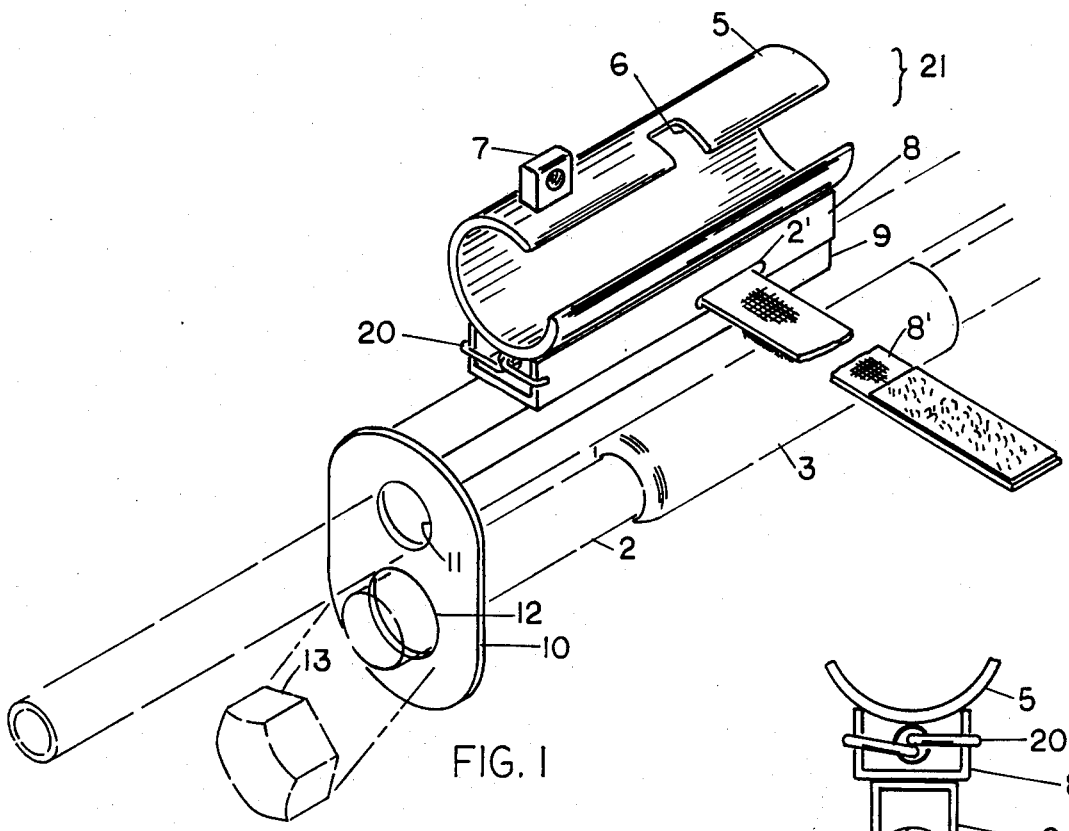
FIG. 1 is a perspective side view of the device, mounted on the barrel of a shot gun.
Figure 3:
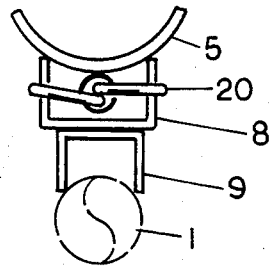
FIG. 3 is a cross sectional view taken on the line 3—3 of FIG. 2.
Figure 2:
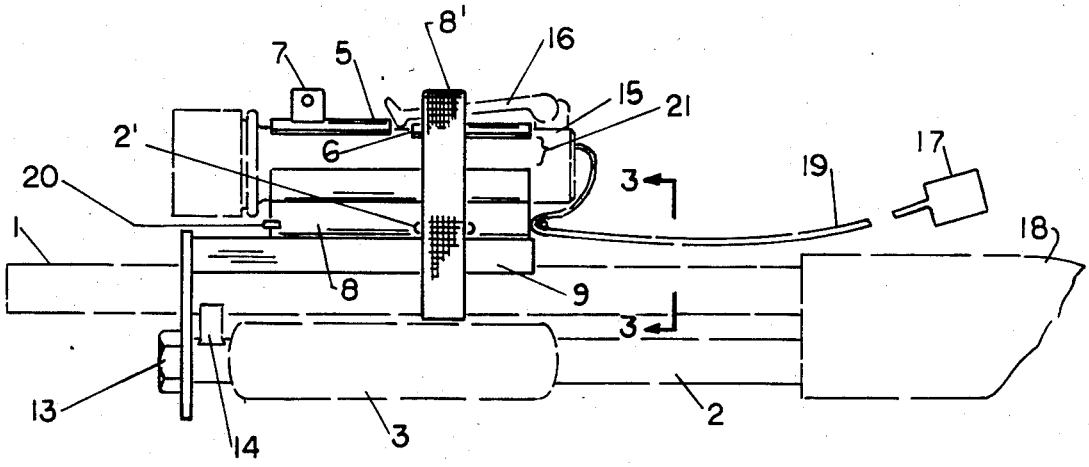
FIG. 2 is a side elevational view.

In the drawings, the numeral 1 designates the barrel of a shot gun having the usual magazine 2 and loading jack 3. The barrel and magazine are maintained in parallel position. A flashlight holder shown in FIG. 1 consists of the housing 5, semi tubular in conformation and having a notch 6 to receive a latch, and having a sling receiver 7 on the top surface thereof.

An upper channel member 8 and a lower channel member 9 are mounted on the housing 5, the extended side margins of the member 8 being secured as by welding, to the housing 5, and the extended side members of the channel member 9 are adapted to seat longitudinally on, and embrace, the barrel 1 of a shot gun.

Mounted on one end of the member 8 is the support 10 which is provided with an orifice 11 through which the barrel 1 passes and the orifice 12 through which the end of the magazine 2 passes, the cap 13 of the magazine 2 being removed to permit the end thereof to pass through the orifice 12, where the cap is then replaced, and moved against the support 10 which bears against the barrel-magazine joinder 14 and received by the usual threads on the magazine 2.

A longitudinal slot 2' in the side walls of the member 8 receives a strap, preferably of Velcros' which is wrapped around the housing 5, and flashlight clip 16 and the barrel 1, and secured in the usual manner.

A flashlight, preferably one having an octagonal housing, such as the sea-divers light in common use, providing a flat surface for firm seating in the housing 5, and having a clip 16, and the barrel 1 and magazine 2 being spaced apart sufficiently to permit the passage of the strap therebetween, and the clip end fitting in the notch 6 effectively maintain the light on the barrel while in use. The touch switch 17 is secured to the stock 18 of the shot gun where it will be convenient to a finger of a user without having to release the finger on the trigger of the gun. A cable 19 extends from the flashlight 15 to the switch 17 and a spring 20 is mounted in the member 8, under tension, and the cable 19 may be twisted around one end of the spring 20 to keep the cable to the touch switch taught, and along the top of the stock, during use.

A light so mounted on the shot gun barrel 1 will send a beam of light at a very close proximity to the point of impact of the charge from the shot gun when discharged.

In mounting the light holder, the cap 13 on the magazine 2 is removed, and the support moved into place, inserting the barrel of the gun through the port 11, and the end of the magazine through the port 12, with the support 10 abutting the joinder 14, then the cap is replaced on the magazine and the strap 8' wrapped around the light, and extended through the slots 2' and pressed against the wrapped strap. The light may be removed from the housing 5 by removing the strap 8', turning the light 15 clockwise one turn, which will move the clip 16 out of the notch 6, and then passing the housing 15 laterally through the gap 21 and the cable 19 removed from the spring 20.

What I claim is:

1. A light attachment for a firearm having the usual barrel and magazine in vertical parallel relation, a housing adapted to receive a flashlight, a conduit having a touch switch selectively positioned on the firearm for operation of the light, a support having ports to receive the barrel and magazine and a strap adapted to aid in maintaining the light in place, said strap passes transversely through the housing and over the housing and light and is releasably secured in holding position.

2. A light attachment for a firearm having the usual barrel and magazine in vertical parallel relation, a housing adapted to receive a flashlight, a conduit having a touch switch selectively positioned on the firearm for operation of the light, a support having ports to receive the barrel and magazine and a strap adapted to aid in maintaining the light in place, a spring is mounted in said housing to which the conduit is secured to maintain tension thereon to retain the conduit in place during the operation of the firearm.

3. A light attachment for a firearm having the usual barrel and magazine in vertical parallel relation, a housing adapted to receive a flashlight, a conduit having a touch switch selectively positioned on the firearm for operation of the light, a support having ports to receive the barrel and magazine and a strap adapted to aid in maintaining the light in place, said housing is semi tubular, having a longitudinal gap through which a flashlight is moved into position in the housing.

4. A light attachment for a firearm having the usual barrel and magazine in vertical parallel relation, a housing adapted to receive a flashlight, a conduit having a touch switch selectively positioned on the firearm for operation of the light, a support having ports to receive the barrel and magazine and a strap adapted to aid in maintaining the light in place, said support is secured to the housing and said housing is maintained on the top of said barrel.

* * * * *